US009212438B2

(12) United States Patent
Kato et al.

(10) Patent No.: US 9,212,438 B2
(45) Date of Patent: Dec. 15, 2015

(54) SEWING MACHINE AND UPPER FEED DEVICE

(71) Applicants: Harumi Kato, Nagoya (JP); Midori Magara, Nagoya (JP)

(72) Inventors: Harumi Kato, Nagoya (JP); Midori Magara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 310 days.

(21) Appl. No.: 13/917,202

(22) Filed: Jun. 13, 2013

(65) Prior Publication Data

US 2014/0000499 A1 Jan. 2, 2014

(30) Foreign Application Priority Data

Jun. 28, 2012 (JP) ..... 2012-144988

(51) Int. Cl.
*D05B 19/16* (2006.01)
*D05B 27/04* (2006.01)

(52) U.S. Cl.
CPC ..... *D05B 19/16* (2013.01); *D05B 27/04* (2013.01)

(58) Field of Classification Search
CPC ..... D05B 29/08; D05B 29/10; D05B 19/16; D05B 24/04
USPC ..... 700/136–138
See application file for complete search history.

(56) References Cited

U.S. PATENT DOCUMENTS 1,715,119 A 5/1929 Clarkson
3,800,719 A * 4/1974 Rockerath ..... 112/304
4,072,115 A 2/1978 Marforio
4,187,795 A 2/1980 Norton
4,632,046 A * 12/1986 Barrett et al. ..... 112/470.13
4,719,864 A 1/1988 Barrett et al.
4,836,119 A * 6/1989 Siraco et al. ..... 112/306
4,928,611 A 5/1990 Ogawa
5,331,910 A 7/1994 Mukai et al.
5,410,975 A * 5/1995 Dudek et al. ..... 112/113
5,579,708 A * 12/1996 Kambara et al. ..... 112/155

(Continued)

FOREIGN PATENT DOCUMENTS

JP A-59-149178 8/1984
JP A-59-164091 9/1984

(Continued)

OTHER PUBLICATIONS

U.S. Appl. No. 14/020,040, filed Sep. 6, 2013 in the name of Ihira et al.

(Continued)

*Primary Examiner* — Danny Worrell
(74) *Attorney, Agent, or Firm* — Oliff PLC

(57) ABSTRACT

A sewing machine includes a first drive portion, a switching portion, a second drive portion, a control portion, and a memory. The first drive portion is configured to drive to feed, in a first direction, a work cloth. The switching portion is configured to switch a position of the first drive portion. The second drive portion is configured to drive to feed the work cloth. The memory is configured to store computer-readable instructions that instruct the sewing machine to execute steps of driving the first drive portion in the first position in a case where the second drive portion drives to feed the work cloth in the first direction and switching the position of the first drive portion to the second position in a case where the second drive portion drives to feed the work cloth in a second direction, based on the sewing data.

8 Claims, 12 Drawing Sheets

(56) References Cited

U.S. PATENT DOCUMENTS

| | | | | |
|---|---|---|---|---|
| 6,123,039 | A * | 9/2000 | Niino | 112/235 |
| 6,415,727 | B1 | 7/2002 | Burgess et al. | |
| 8,904,946 | B2 * | 12/2014 | Ihira et al. | 112/318 |

FOREIGN PATENT DOCUMENTS

| | | |
|---|---|---|
| JP | U-61-054771 | 4/1986 |
| JP | A-62-129092 | 6/1987 |
| JP | A-04-348792 | 12/1992 |
| JP | A-05-269282 | 10/1993 |
| JP | A-2004-223005 | 8/2004 |

OTHER PUBLICATIONS

U.S. Appl. No. 13/777,598, filed Feb. 26, 2013 in the name of Midori Magara et al.

Jul. 18, 2014 Office Action issued in U.S. Appl. No. 14/020,040.

Aug. 11, 2014 Miscellaneous Communication issued in U.S. Appl. No. 14/020,040.

* cited by examiner

FIG. 10

90

| STITCH NUMBER N | SWING DATA | FRONT-REAR FEED DATA | TRANSVERSE FEED DATA |
|---|---|---|---|
| 1 | 0mm | 0mm | 0mm |
| 2 | 1.5mm | 0mm | 0.5mm |
| 3 | 1.5mm | 0mm | 0.5mm |
| 4 | 1.0mm | 2mm | 0mm |
| 5 | 1.0mm | 2mm | 0mm |
| 6 | 0.5mm | 1mm | 0mm |
| 7 | 1.5mm | 0mm | 0.5mm |
| 8 | 1.5mm | 0mm | 0.5mm |
| 9 | -1.5mm | 0mm | -0.5mm |
| 10 | -1.5mm | 0mm | -0.5mm |
| 11 | -1.0mm | 2mm | 0mm |
| 12 | -1.0mm | 2mm | 0mm |
| 13 | -0.5mm | 1mm | 0mm |
| 14 | -1.5mm | 0mm | -0.5mm |
| 15 | -1.5mm | 0mm | -0.5mm |
| ⋮ | ⋮ | ⋮ | ⋮ |

SEWING MACHINE AND UPPER FEED DEVICE

CROSS-REFERENCE TO RELATED APPLICATION

This application claims priority to Japanese Patent Application No. 2012-144988 filed Jun. 28, 2012, the content of which is hereby incorporated herein by reference.

BACKGROUND

The present disclosure relates to a sewing machine and an upper feed device.

A sewing machine is known that includes an upper feed device that is disposed higher than a bed of the sewing machine and that is capable of feeding a sewing object (a work cloth). For example, the sewing machine may be provided with a pull-feeding roller (which is equivalent to the upper feed device) above a support platform (which is equivalent to the bed). The pull-feed roller includes a roller element. The roller element is configured such that its position can be switched between a feed position and a released position. When a user switches the roller element to the feed position, the roller element may press the sewing object and, in synchronization with a feed dog, may feed the sewing object toward the rear of the sewing machine. When the user switches the roller element to the released position, the roller element may be separated from the sewing object. The user may therefore remove the sewing object from the support platform.

SUMMARY

A sewing machine is known that can sew a large pattern by using the feed dog to feed the sewing object not only in the front-rear direction, but also in the transverse (left-right) direction. However, in the upper feed device that is described above, the roller element can press and move the sewing object only toward the rear. Therefore, the roller element cannot feed the sewing object in the transverse direction. In a case where the upper feed device that is described above is being used while a large pattern is being sewn by using the feed dog to feed the sewing object in the front-rear direction and in the transverse direction, the roller element is pressing the sewing object, so the upper feed device cannot feed the sewing object properly in the transverse direction.

Embodiments of the broad principles derived herein provide a sewing machine and an upper feed device, the upper feed device being configured to be automatically separated from a sewing object when the sewing object is fed in a direction that is different from the direction in which the upper feed device feeds the sewing object.

Embodiments provide a sewing machine that includes a first drive portion, a switching portion, a second drive portion, a control portion, and a memory. The first drive portion is disposed above a bed of the sewing machine and is configured to drive to feed, in a first direction, a work cloth placed on the bed. The switching portion is configured to switch a position of the first drive portion between a first position and a second position. The first drive portion is configured to feed the work cloth at the first position. The first drive portion is configured to be separated from the work cloth at the second position. The second position is a position that is higher and farther away from the bed than the first position. The second drive portion is provided inside the bed and is configured to drive to feed the work cloth in the first direction and in a second direction that is different from the first direction. The memory is configured to store computer-readable instructions that instruct the sewing machine to execute steps of driving the first drive portion in the first position, in a case where the second drive portion drives to feed the work cloth in the first direction, based on sewing data, and switching the position of the first drive portion from the first position to the second position by operating the switching portion, in a case where the second drive portion drives to feed the work cloth in the second direction, based on the sewing data.

Embodiments also provide an upper feed device that includes a first drive portion and a switching portion. The first drive portion is disposed above a bed of a sewing machine and is configured to drive to feed, in a first direction, a work cloth placed on the bed. The switching portion is configured to switch a position of the first drive portion between a first position and a second position. The first drive portion is configured to feed the work cloth at the first position. The first drive portion is configured to be separated from the work cloth at the second position. The second position is a position that is different from the first position. In response to instructions that is output by a control portion of the sewing machine based on sewing data, the first drive portion drives in the first position in a case where a second drive portion drives to feed the work cloth in the first direction, and the switching portion switches the position of the first drive portion from the first position to the second position in a case where the second drive portion drives to feed the work cloth in a second direction that is different from the first direction. The second drive portion is provided inside the bed.

BRIEF DESCRIPTION OF THE DRAWINGS

Embodiments will be described below in detail with reference to the accompanying drawings in which:

FIG. 10 is a data configuration diagram of a sewing data table;

DETAILED DESCRIPTION

Hereinafter, an embodiment will be explained with reference to the drawings. A sewing machine 1 according to the present embodiment can form a stitch on a work cloth by moving the work cloth in relation to a needle that is moved up and down. The sewing machine 1 according to the present embodiment is an example of a sewing machine to which an upper feed device 4, which will be described below, can be mounted.

Figure 1:
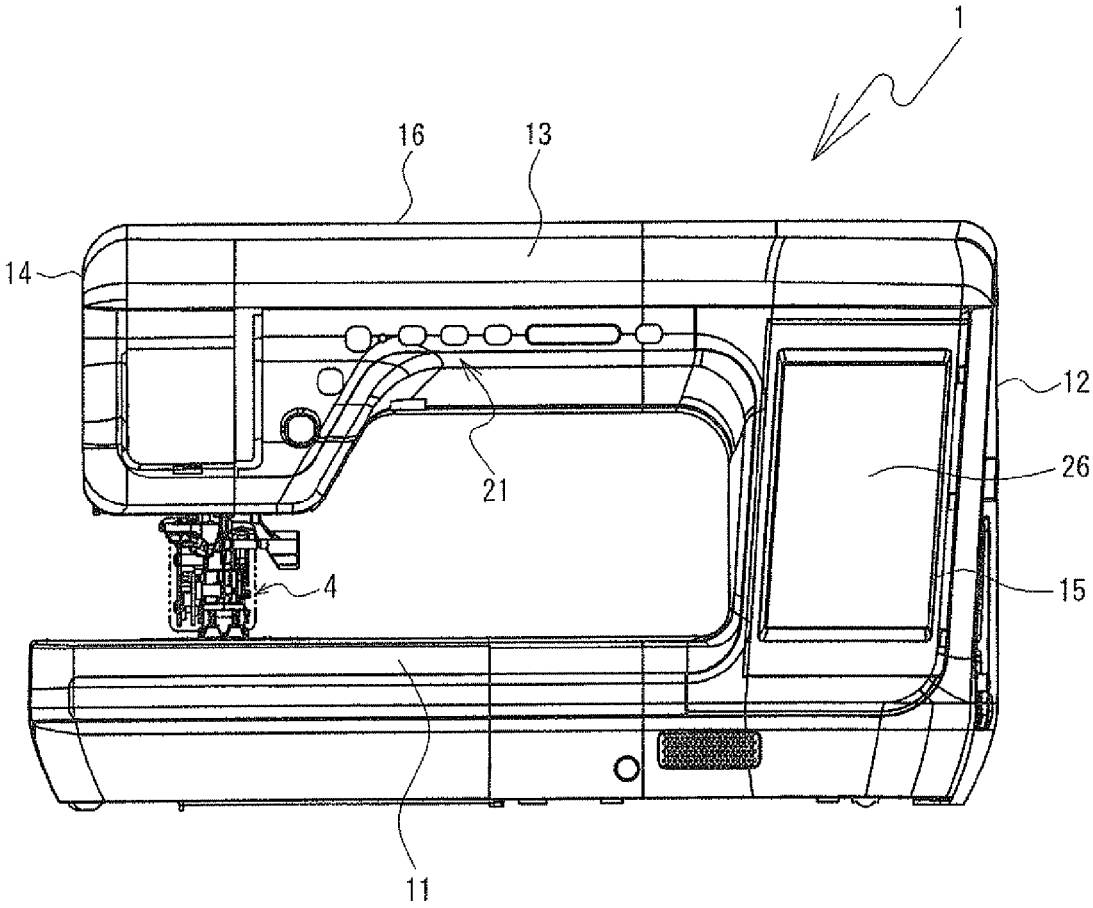
FIG. 1 is a front view of a sewing machine.
Figure 2:
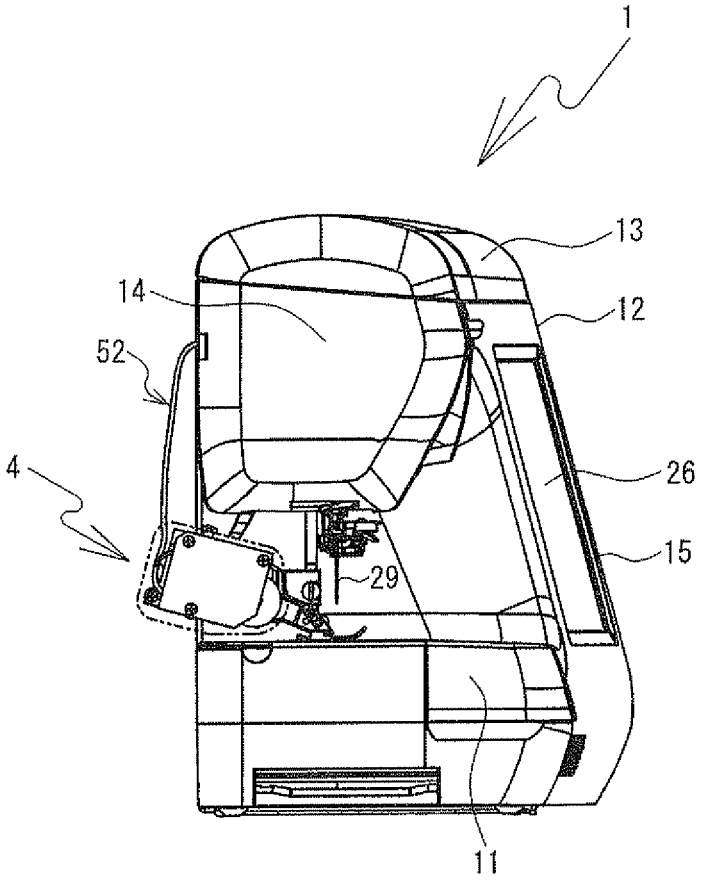
FIG. 2 is a left side view of the sewing machine.
Figure 3:
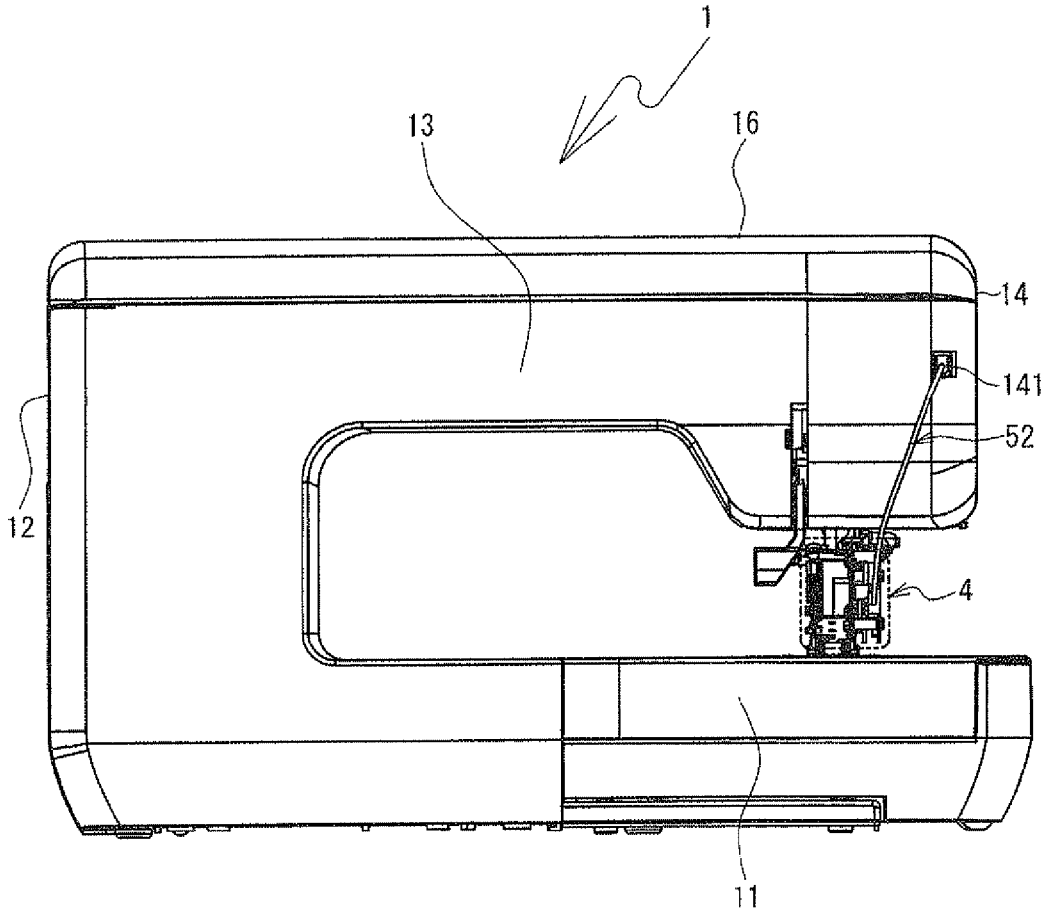
FIG. 3 is a rear view of the sewing machine.

A physical structure of the sewing machine 1 will be explained with reference to FIGS. 1 to 3. In the following explanation, the near side, the far side, the upper side, the lower side, the left side, and the right side of FIG. 1 are respectively defined as the front side, the rear side, the upper side, the lower side, the left side, and the right side of the sewing machine 1. In other words, a direction in which a pillar 12, which will be explained below, extends is the up-down direction of the sewing machine 1. A longitudinal direction of a bed 11 and an arm 13 is the left-right direction of the sewing machine 1. A surface on which a switch cluster 21 is arranged is the front surface of the sewing machine 1.

As shown in FIG. 1, the sewing machine 1 includes the bed 11, the pillar 12, the arm 13, and a head 14. The bed 11 extends in the left-right direction. The pillar 12 extends upward from the right end of the bed 11. The arm 13 extends toward the left from the top end of the pillar 12. The head 14 is provided on the left end of the arm 13. The bed 11 is provided with a needle plate 33 (refer to FIG. 5), a feed dog 34 (refer to FIG. 5), a cloth feed mechanism (not shown in the drawings), a feed adjustment motor 78 (refer to FIG. 9), and a shuttle mechanism (not shown in the drawings). The needle plate 33 is disposed on the top face of the bed 11. The feed dog 34 is provided inside the bed 11, more specifically, underneath the needle plate 33. The feed dog 34 may feed a work cloth 100 (refer to FIG. 5) that is placed on the top face of the bed 11 and the needle plate 33 by a specified feed amount. The cloth feed mechanism may drive the feed dog 34. The feed adjustment pulse motor 78 may adjust the feed amount.

The cloth feed mechanism may drive the feed dog 34 to move in the front-rear direction and in the left-right direction (the transverse direction). The feed dog 34 may feed the work cloth 100 in the front-rear direction and in the left-right direction (the transverse direction). In contrast, a feed mechanism 43 (refer to FIG. 4) of the upper feed device 4, which will be described below, may feed the work cloth 100 only in the front-rear direction. The head 14 is provided with a needle bar mechanism (not shown in the drawings), a needle bar swinging mechanism (not shown in the drawings), a needle bar swinging motor 80 (refer to FIG. 9), and a thread take-up mechanism (not shown in the drawings). The needle bar mechanism may drive a needle bar (not shown in the drawings) in the up-down direction. A sewing needle 29 (refer to FIG. 2) may be attached to the needle bar. The needle bar swinging mechanism may swing the needle bar to the left and to the right. The needle bar swinging motor 80 may drive the needle bar swinging mechanism.

A liquid crystal display 15 is provided on the front face of the pillar 12. The liquid crystal display 15 has a vertical rectangular shape. For example, keys that are used to execute various functions necessary to the sewing operation, various messages, and various patterns etc. may be displayed on the liquid crystal display 15. A transparent touch panel 26 is provided in the upper surface (front surface) of the liquid crystal display 15. A user may perform an operation of pressing the touch panel 26, using a finger or a dedicated touch pen, in a position corresponding to one of the various keys or the like displayed on the liquid crystal display 15. This operation is hereinafter referred to as a "panel operation". By performing the panel operation, the user may perform selection of a sewing pattern (a sewing data table), various settings, and the like.

The structure of the arm 13 will be explained. A cover 16 is attached to the upper portion of the arm 13 along the longitudinal direction of the arm 13. The cover 16 is supported such that the cover 16 can be opened and closed by being rotated about an axis that extends in the left-right direction at the upper rear edge of the arm 13. A thread container portion (not shown in the drawings) is provided close to the middle of the top of the arm 13 under the cover 16. The thread container portion is a recessed portion for containing a thread spool (not shown in the drawings). A spool pin is provided in the thread container portion. A thread spool may be mounted to the spool pin. The head 14 is provided with a thread guide that includes a tensioner, a thread take-up spring, a thread take-up lever, and the like, which are not shown in the drawings. An upper thread (not shown in the drawings) may be supplied from the thread spool via the thread guide to the sewing needle 29 that is attached to the needle bar.

A sewing machine motor 79 (refer to FIG. 15) is provided inside the pillar 12. The sewing machine motor 79 may rotate a drive shaft (not shown in the drawings). The drive shaft extends in the direction in which the arm 13 extends. The needle bar mechanism and the thread take-up mechanism may be driven by the rotating of the drive shaft. The switch cluster 21 is provided on the lower part of the front face of the arm 13. The switch cluster 21 includes a sewing start/stop switch, a reverse stitch switch, a needle up/down switch, and the like.

A presser bar 27 (refer to FIG. 5) is located at the rear of the needle bar. The upper feed device 4 may be mounted to the lower end of the presser bar 27. The upper feed device 4 may be positioned higher than the bed 11. The upper feed device 4 may feed the work cloth 100 by operating in coordination with the feed dog 34.

Figure 4:
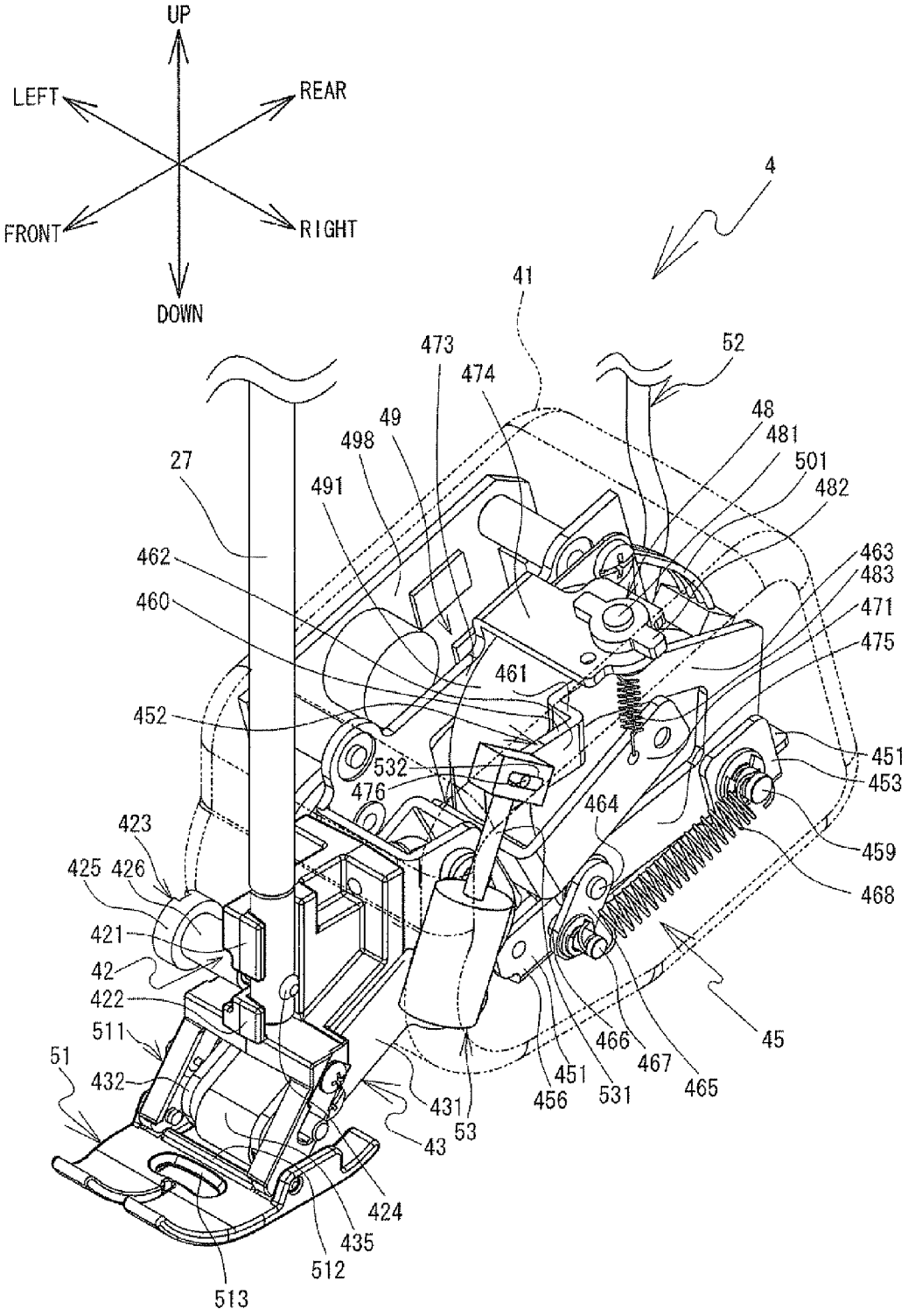
FIG. 4 is an oblique view of an upper feed device when a feed mechanism is in a feed position.
Figure 5:
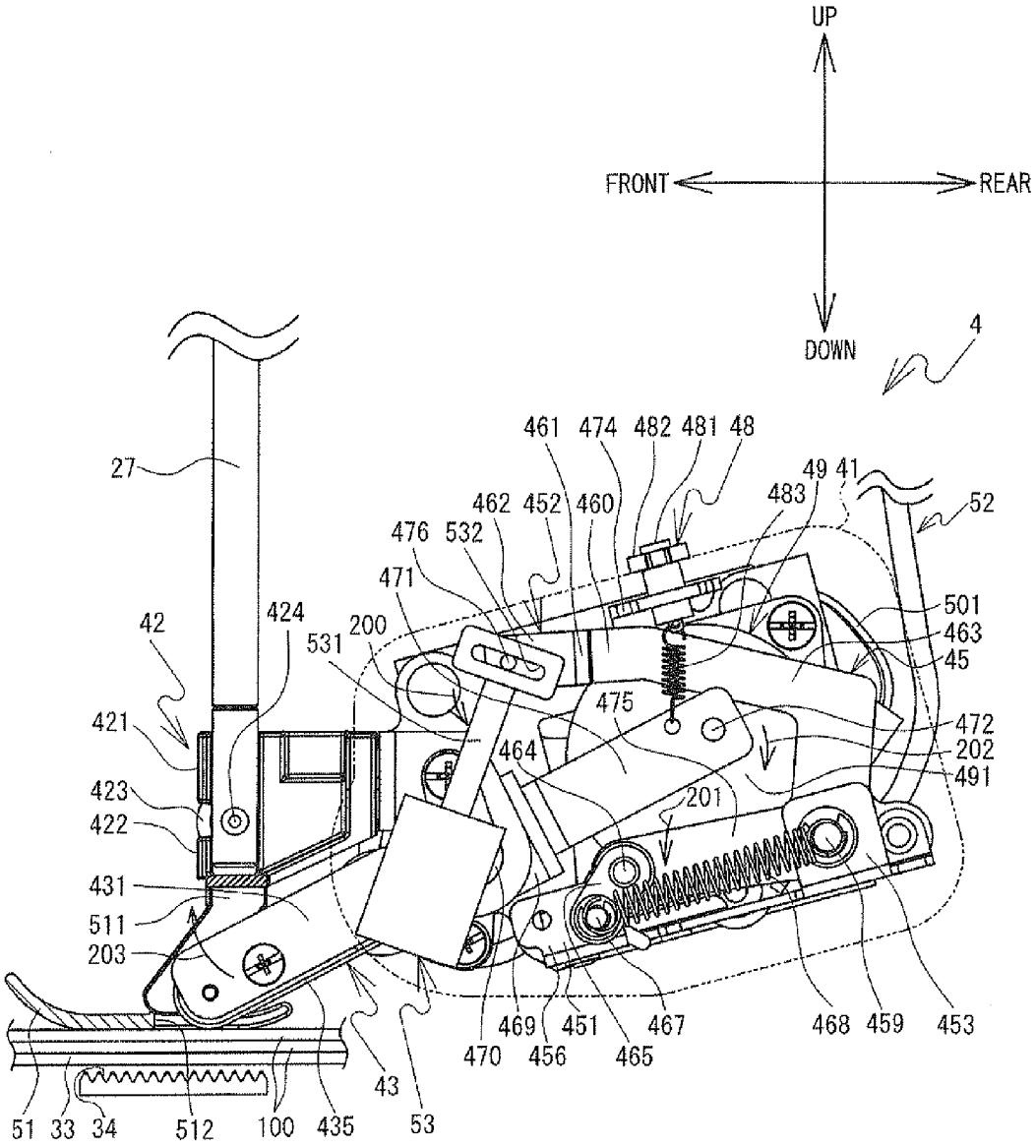
FIG. 5 is a right side view of the upper feed device when the feed mechanism is in the feed position, with an area including a presser foot shown in cross section.

The upper feed device 4 will be explained with reference to FIGS. 4 to 7. As shown in FIGS. 4 and 5, the upper feed device 4 includes a housing 41, a mounting portion 42, the feed mechanism 43, a drive mechanism 49, a switching mechanism 45, a pressure adjustment mechanism 48, a connecting portion 52, and a presser foot 51. The mounting portion 42 is a portion by which the upper feed device 4 can be mounted on the presser bar 27 of the sewing machine 1. The feed mechanism 43 may be disposed above the bed 11. The feed mechanism 43 may feed the work cloth 100 that is placed on the bed 11 in the front-rear direction. The drive mechanism 49 may drive the feed mechanism 43. The switching mechanism 45 may switch the position of the feed mechanism 43 between a feed position (refer to FIG. 5) and a standby position (refer to FIG. 6). The feed position is a position in which the feed mechanism 43 can press and feed the work cloth 100. The standby position is a position in which the feed mechanism 43 is separated from the work cloth 100 and does not feed the work cloth 100. The connecting portion 52 may electrically connect a motor 491 and a solenoid 53 to a control portion 60 (refer to FIG. 9) of the sewing machine 1. The motor 491 is provided in the drive mechanism 49. The solenoid 53 is provided in the switching mechanism 45. The pressure adjustment mechanism 48 may adjust the pressure of a belt 435 on the work cloth 100. The belt 435 is provided in the feed mechanism 43.

Figure 6:
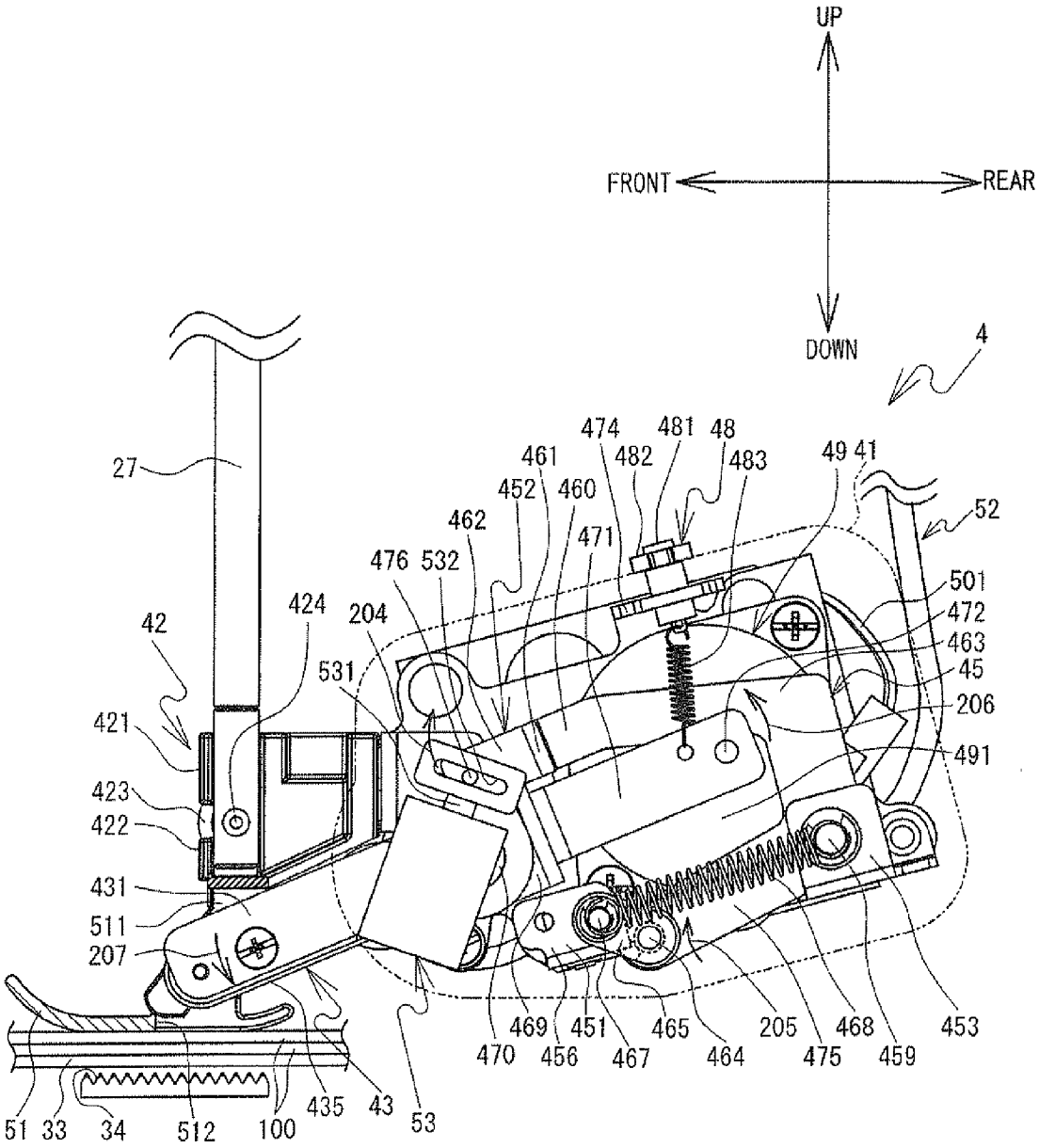
FIG. 6 is a right side view of the upper feed device when the feed mechanism that is shown in FIG. 5 has moved to a standby position.

The switching mechanism 45 is provided inside the housing 41. The switching mechanism 45 includes a base portion 451, a lever plate 452, a spring 468, a rotating member 469, a rotating plate 471, and the solenoid 53. The base portion 451 is a plate-shaped member that extends in the front-rear direction at the lower portion inside the housing 41. Bent portions are provided on the side faces of the front and rear ends of the base portion 451. The bent portions are portions that are each bent upward from the base portion 451. FIGS. 4 to 6 show a bent portion 453 and a bent portion 456 among the bent portions. The bent portion 453 is provided in the right rear part of the base portion 451. The bent portion 456 is provided in the right front part of the base portion 451.

A shaft member 459 is inserted through the bent portion 453. The plate-shaped lever plate 452 is provided on the left end of the shaft member 459. The lever plate 452 can be rotated with the shaft member 459 as the center of rotation. The lever plate 452 includes a lever portion 460 and an extension portion 475. The lever portion 460 extends upward from the location where the shaft member 459 is inserted, and then extends toward the front. At a bent portion 461 that is in a central portion of the lever portion 460 in the front-rear direction, the lever portion 460 bends toward the right and then extends toward the front again. A cylindrical portion 476 is provided on the tip of the lever portion 460. The cylindrical portion 476 projects toward the right from the lever portion 460. The solenoid 53 is disposed below and in front of the tip of the lever portion 460. The solenoid 53 includes a drive shaft 531. The drive shaft 531 projects upward and rearward. The tip of the drive shaft 531 is formed into a rectangular shape in a right side view and is provided with a hole 532, which passes through the tip in the left-right direction. The hole 532 extends obliquely from the upper front to the lower rear. The cylindrical portion 476 is fitted into the hole 532 such that the cylindrical portion 476 can slide within the hole 532. The solenoid 53 may move the drive shaft 531 to the upper rear and to the lower front. The drive shaft 531 may thus move the lever portion 460 up and down by acting on the cylindrical portion 476. In the explanation that follows, the part of the lever portion 460 that is toward the front from the position of the bent portion 461 is referred to as a lever front end portion 462, and the part of the lever portion 460 that is toward the rear from the position of the bent portion 461 is referred to as a lever rear end portion 463.

The extension portion 475 extends toward the front from the location where the shaft member 459 is inserted. A shaft member 464 is inserted through the front end portion of the extension portion 475 in the left-right direction. The shaft member 464 may be moved up and down in conjunction with the rotation of the lever plate 452. A detector switch 457 (refer to FIG. 9) is disposed on the base portion 451. The left end portion of the shaft member 464 turns the detector switch 457 on and off by moving up and down.

As shown in FIG. 5, a rear end portion of a linking member 465 is coupled to the right end portion of the shaft member 464. A hole 466 is provided in the bent portion 456 in the right front portion of the base portion 451 (refer to FIG. 4). The hole 466 is slightly elongated in the front-rear direction. A shaft member 467 is inserted through the hole 466. The shaft member 467 can be slid in the front-rear direction within the hole 466. The shaft member 467 is coupled to the front end portion of the linking member 465. The spring 468 is provided such that the shaft member 467 is coupled with the shaft member 459. The spring 468 is provided in an extended state. Therefore, the spring 468 constantly generates a force in the direction of contraction. The shaft member 467 is therefore pulled toward the rear by the spring 468. Accordingly, the shaft member 467 is in contact with the rear end portion of the hole 466 (refer to FIG. 4).

As shown in FIG. 5, the rotating member 469 is provided above the front end of the base portion 451. The rotating member 469 can be rotated with a central shaft 470 of the rotating member 469 as the center of rotation. The rotating plate 471 is coupled to the rear portion of the rotating member 469. The rotating plate 471 extends obliquely upward and rearward. The rear portion of the rotating plate 471 is positioned to the right of the lever rear portion 463 (refer to FIG. 4). A shaft member 472 (not shown in FIG. 4) extends toward the left from the rear end portion of the rotating plate 471. The shaft member 472 is positioned below the lever rear portion 463. The front end of the rotating member 469 is coupled to the feed mechanism 43.

The feed mechanism 43 will be explained. The feed mechanism 43 extends obliquely downward and forward. The feed mechanism 43 includes plate portions 431, 432 (refer to FIG. 4), pulleys 433, 434 (refer to FIG. 7), and the belt 435. As shown in FIG. 4, the plate portions 431 and 432 are positioned opposite one another. The plate portions 431 and 432 extend obliquely downward toward the front from the front end of the rotating member 469 (refer to FIG. 5). The front end portions of the plate portions 431 and 432 support the pulley 433 such that the pulley 433 can be rotated. The rear end portions of the plate portions 431 and 432 support the pulley 434 such that the pulley 434 can be rotated. The belt 435 is provided around the pulley 433 and the pulley 434 (refer to FIG. 7). The front end portion of the belt 435 is positioned at a belt positioning portion 512 (described below) of the presser foot 51. When the feed mechanism 43 is in the feed position (refer to FIG. 5), the part of the belt 435 that is below the pulley 433 may press the work cloth 100 and may feed the work cloth 100 in the front-rear direction. The way in which the position of the feed mechanism 43 is switched by the switching mechanism 45 will be described below.

A structure for adjusting the pressure when the feed mechanism 43 presses against the work cloth 100 will be explained. A lower edge portion of a plate portion 473 (refer to FIG. 4) is affixed by screws (not shown in the drawings) to the bent portions (not shown in the drawings) on the left side of the base portion 451. As shown in FIG. 4, the plate portion 473 extends upward. An extension portion 474, which extends toward the right, is provided in a central portion of the upper edge of the plate portion 473 in the front-rear direction. The extension portion 474 is positioned above the motor 491 (described below). The pressure adjustment mechanism 48 is provided on the right end portion of the extension portion 474.

The pressure adjustment mechanism 48 includes a male threaded portion 481, a female threaded portion 482, and a spring 483. The male threaded portion 481 penetrates in the up-down direction through the top face of the housing 41 and through the extension portion 474. The female threaded portion 482 is located on the top side of the top face of the housing 41 above the extension portion 474 (refer to FIG. 5). The upper end portion of the male threaded portion 481 is inserted through the female threaded portion 482. The upper end portion of the spring 483 is fixed to the lower end portion of the male threaded portion 481. The spring 483 extends downward. The lower end portion of the spring 483 is fixed to the rear end portion of the rotating plate 471. The spring 483 pulls the rear end portion of the rotating plate 471 upward.

The male threaded portion 481 is moved in the up-down direction when the female threaded portion 482 is turned. When the male threaded portion 481 is moved upward, the spring 483 is extended. Therefore, the force with which the spring 483 pulls the rear end portion of the rotating plate 471 upward becomes stronger. When the rotating plate 471 is pulled upward, a force is applied to the feed mechanism 43 in a counterclockwise direction as seen from the right side, with the central shaft 470 serving as the center of rotation. Therefore, the force with which the front end portion of the belt 435 presses downward against the work cloth 100 becomes stronger. When the male threaded portion 481 is moved downward, the spring 483 contracts. Therefore, the force with which the spring 483 pulls the rear end portion of the rotating plate 471 upward becomes weaker. Accordingly, the force with which the belt 435 presses against the work cloth 100 becomes weaker. In this manner, the force with which the belt 435 presses against the work cloth 100 can be adjusted by adjusting pressure adjustment mechanism 48.

The mounting portion 42 and the presser foot 51 will be explained. As shown in FIG. 4, the mounting portion 42 is provided above the feed mechanism 43 in the front end portion of the upper feed device 4. The mounting portion 42 includes two holding portions 421 and 422. The holding portions 421 and 422 are mounted on and fixed to the presser bar 27 by a shoulder screw 423. The shoulder screw 423 includes a head 425, a shank 426, and a threaded portion 424. The outside diameter of the shank 426 is slightly smaller than the outside diameter of the head 425. The outside diameter of the threaded portion 424 is slightly smaller than the outside diameter of the shank 426. The holding portions 421 and 422 are provided on the front end of the upper feed device 4. The holding portion 421 is provided above the holding portion 422 and is set apart slightly from the holding portion 422. Each of the holding portions 421 and 422 has a recessed portion that is recessed toward the left. The lower end portion of the presser bar 27 may be disposed in the recessed portions. A threaded hole (not shown in the drawings) is provided in the lower end portion of the presser bar 27. The threaded hole extends through the presser bar 27 in the left-right direction. The threaded portion 424 may be screwed into the threaded hole. A slot (not shown in the drawings) is formed in the left side face of the head 425. A tool (not shown in the drawings), which will be described below, may be fitted into the slot.

When mounting the upper feed device 4 to the presser bar 27, the user may match the position of the threaded portion 424 to the position of the threaded hole in the presser bar 27. In that state, the user may turn the head 425 with his or her fingers or fit the tool into the slot to turn the head 425. The right side face of the shank 426 may thus come into contact with the left side faces of the holding portions 421 and 422. In that state, if the shoulder screw 423 is turned and tightened, the holding portions 421 and 422 are clamped between the shank 426 and the presser bar 27. In that state, the holding portions 421 and 422 are fixed to the presser bar 27. The upper feed device 4 may thus be mounted to the presser bar 27.

As shown in FIG. 4, a presser foot support portion 511 is provided on the lower edge portion of the holding portion 422. The presser foot support portion 511 straddles the front end portion of the feed mechanism 43 at the left and right. The presser foot support portion 511 extends obliquely downward and forward. The presser foot 51 is provided on the lower end of the presser foot support portion 511. The sewing needle 29 may pass through a hole 513 in the presser foot 51. The belt positioning portion 512 is provided at the rear of the hole 513. The belt positioning portion 512 is a rectangular open portion that extends to the rear edge of the presser foot 51. The front end portion of the belt 435 of the feed mechanism 43 may be disposed on the inner side of the belt positioning portion 512. When the feed mechanism 43 is in the feed position, the part of the belt 435 that is below the pulley 433 may feed the work cloth 100 while pressing downward against the work cloth 100 within the belt positioning portion 512.

The upper feed device 4 may be mounted to the presser bar 27 by the mounting portion 42. Therefore, when the presser bar 27 is moved upward, the upper feed device 4 is also moved upward. The presser foot 51 is also moved away from the work cloth 100. When the presser bar 27 is moved downward, the upper feed device 4 is also moved downward. The presser foot 51 may press downward against the work cloth 100.

Figure 7:
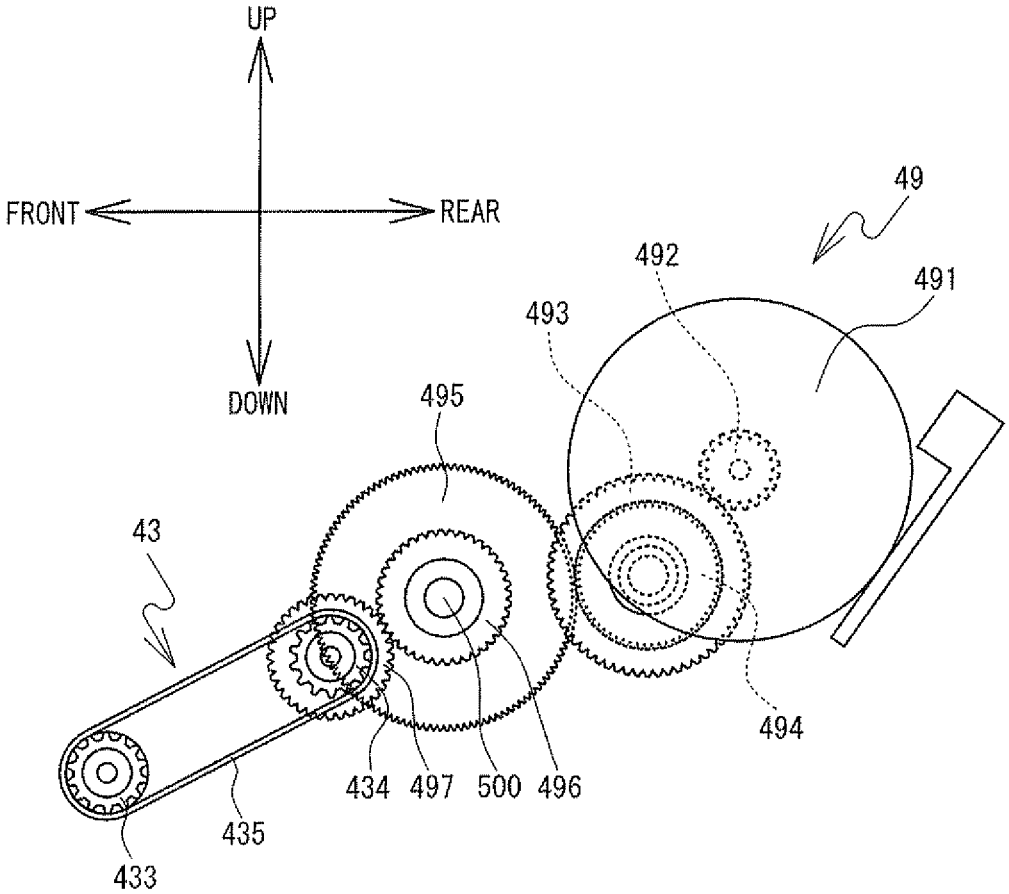
FIG. 7 is a right side view of a drive mechanism that is configured to drive a belt.
Figure 8:
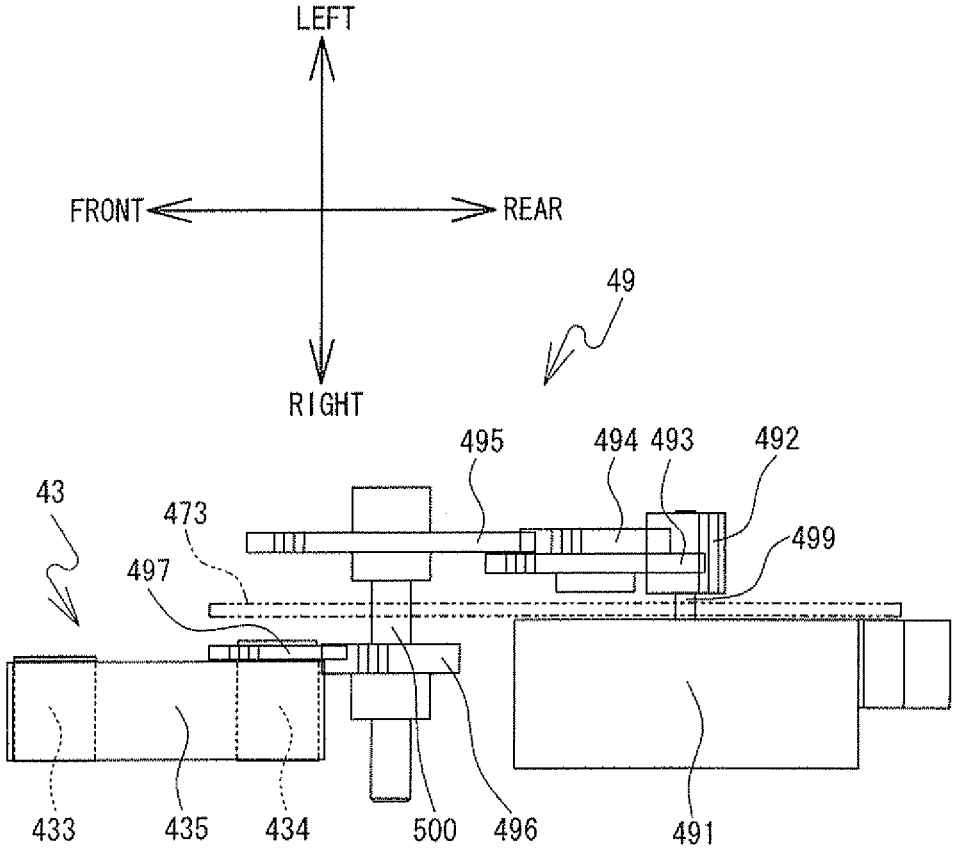
FIG. 8 is a plan view of the drive mechanism that is configured to drive the belt.

The drive mechanism 49 will be explained. As shown in FIGS. 7 and 8, the drive mechanism 49 includes the motor 491, gears 492 to 497, and an electric substrate 498 (refer to FIG. 4). The motor 491 is positioned above the base portion 451 and on the right side of the plate portion 473 (refer to FIGS. 4 and 8). A drive shaft 499 of the motor 491 extends through the plate portion 473 and protrudes from the left side of the plate portion 473 (refer to FIG. 8). The gear 492 is fixed to the projecting end of the drive shaft 499. The gear 493 is positioned obliquely below and at the front of the gear 492. The gear 492 meshes with the gear 493. The gear 494 is provided on the left side face of the gear 493. The diameter of the gear 494 is smaller than the diameter of the gear 493. The gears 493 and 494 are formed as a single unit. The gear 495 is positioned in front of the gear 494. The gear 494 meshes with the gear 495. The gear 495 is provided around a central shaft 500. The central shaft 500 extends through the plate portion 473 and protrudes from the right side of the plate portion 473 (refer to FIG. 8). The gear 496 is provided around the central shaft 500 at the right of the plate portion 473. The gear 496 meshes with the gear 497, which is in front of the gear 496. The gear 497 is formed as a single unit with the pulley 434 of the feed mechanism 43. The electric substrate 498 (refer to FIG. 4) is positioned at the left of the plate portion 473 and the gear 495. The motor 491 is connected to the electric substrate 498 through a lead wire 501 (refer to FIGS. 4 and 5).

Figure 9:
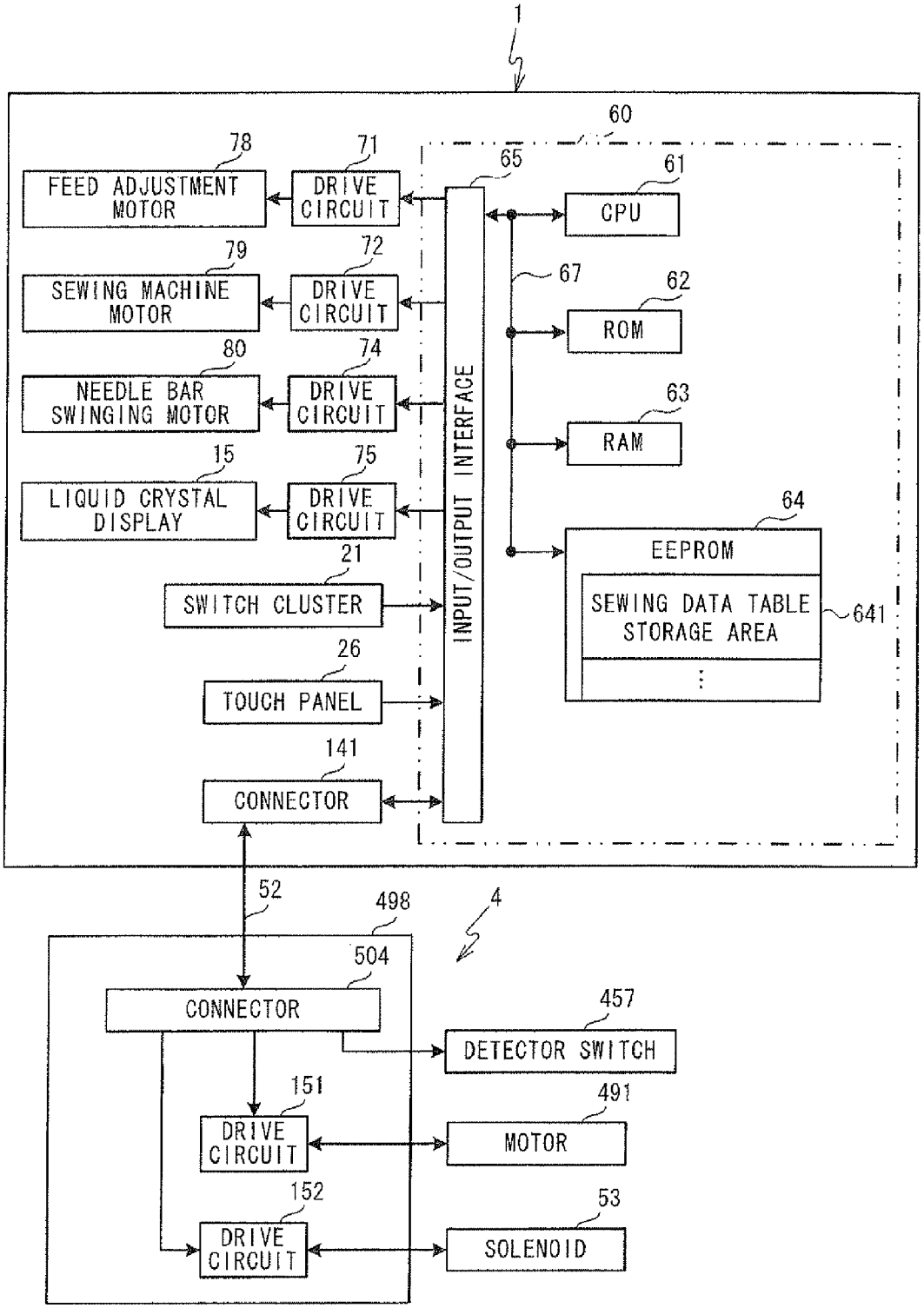
FIG. 9 is a block diagram that shows an electrical configuration of the sewing machine and the upper feed device.

The connecting portion 52 is connected to the electric substrate 498 via a connector 504 (refer to FIG. 9). As shown in FIG. 3, the connecting portion 52 extends from the electric substrate 498 to the outside of the housing 41 of the upper feed device 4 and may be connected to a connector 141 that is provided in the head 14 of the sewing machine 1. The connector 141 is electrically connected to the control portion 60 (refer to FIG. 9) of the sewing machine 1. The motor 491 and the solenoid 53 are electrically connected to the control portion 60 of the sewing machine 1 via the electric substrate 498, the connecting portion 52, and the connector 141.

When the motor 491 turns, the pulley 434 is rotated via the gears 492 to 497. When the pulley 434 is rotated, the belt 435 is moved. The pulley 433 is rotated in conjunction with the moving of the belt 435. The belt 435 can feed the work cloth 100 by moving while making contact with the work cloth 100. Furthermore, in a case where the work cloth 100 is fed in the front-rear direction, the control portion 60 can perform control that synchronizes the timing of the operation by which the upper feed device 4 feeds the work cloth 100 and the timing of the operation by which the feed dog 34 feeds the work cloth 100. Accordingly, the upper feed device 4 and the feed dog 34 can operate in coordination to feed the work cloth 100 in the front-rear direction.

The way in which the position of the feed mechanism 43 is switched between the feed position (refer to FIG. 5) and the standby position (refer to FIG. 6) will be explained. The upper feed device 4 can switch the position of the feed mechanism 43 between the feed position and the standby position by driving the solenoid 53 of the switching mechanism 45 in accordance with a command that is output by a CPU 61 based on the sewing data table, which is stored in an EEPROM 64.

A case in which the position of the feed mechanism 43 is switched from the feed position to the standby position will be explained. In this case, the CPU 61 controls the solenoid 53 to move the drive shaft 531 obliquely downward and forward. The tip of the lever portion 460 is moved downward in conjunction with the movement of the drive shaft 531 (refer to the arrow 200 in FIG. 5). Then the lever plate 452 is rotated counterclockwise, as seen from the right side, with the shaft member 459 as the center of rotation. That causes the extension portion 475 of the lever plate 452 and the shaft member 464 to rotate downward (refer to the arrow 201 in FIG. 5).

Then the shaft member 467 is pushed toward the front via the linking member 465, and the shaft member 467 slides toward the front along the hole 466 (refer to FIG. 4) against the contracting force of the spring 468.

When the shaft member 464 of the extension portion 475 is moved lower than the position of the spring 468 in the up-down direction, the shaft member 467 is pulled toward the rear by the contracting force of the spring 468 and by the movement of the linking member 465. Therefore, the shaft member 467 slides toward the rear along the hole 466. When the shaft member 467 is moved to the rear end of the hole 466, the rotation of the lever plate 452 stops (refer to FIG. 6).

In the process of the rotating of the lever plate 452, the lower edge of the lever rear end portion 463 comes into contact with the shaft member 472 that is provided on the rotating plate 471 and pushes the shaft member 472 downward. The rear end of the rotating plate 471 on which the shaft member 472 is provided then is rotated downward, with the central shaft 470 of the rotating member 469 as the center of rotation (refer to the arrow 202 in FIG. 5). Therefore, the feed mechanism 43 is rotated upward, with the central shaft 470 as the center of rotation (refer to the arrow 203 in FIG. 5). The part of the belt 435 that is below the pulley 433 is thereby moved up away from the work cloth 100 (refer to FIG. 6). In other words, the position of the feed mechanism 43 is switched from the feed position (refer to FIG. 5) to the standby position (refer to FIG. 6). The contracting force of the spring 468 operates constantly, so the shaft member 467 can be held in the state in which the shaft member 467 has moved to the rear end of the hole 466. The shaft member 464 can therefore be held in the state in which the shaft member 464 has been moved lower than the spring 468. Therefore, the position of the feed mechanism 43 can be held in the state in which the position of the feed mechanism 43 has been switched to the standby position.

In the process of the switching of the position of the feed mechanism 43 from the feed position (refer to FIG. 5) to the standby position (refer to FIG. 6), the left end of the shaft member 464 of the extension portion 475 turns the detector switch 457 on (refer to FIG. 9). The CPU 61 of the sewing machine 1 can detect that the feed mechanism 43 is in the standby position.

Next, a case will be explained in which the position of the feed mechanism 43 is switched from the standby position (refer to FIG. 6) to the feed position (refer to FIG. 5). In this case, the CPU 61 controls the solenoid 53 to move the drive shaft 531 obliquely upward and rearward. The tip of the lever portion 460 is moved upward in conjunction with the movement of the drive shaft 531. The lever portion 460 and the extension portion 475 operate in the opposite way from how the lever portion 460 and the extension portion 475 operate in the above case where the feed mechanism 43 is switched from the feed position to the standby position (refer to the arrows 204 and 205 in FIG. 6).

When the lever portion 460 is rotated upward, the lever rear end portion 463 begins to move away from the shaft member 472, which is provided on the rotating plate 471. The rotating plate 471 is pulled upward by the spring 483 of the pressure adjustment mechanism 48. The rotating plate 471 is therefore rotated upward, with the central shaft 470 as the center of rotation (refer to the arrow 206 in FIG. 6). Therefore, the feed mechanism 43 is rotated downward (refer to the arrow 207 in FIG. 6). The part of the belt 435 that is below the pulley 433 may thereby come into contact with the work cloth 100 and may press downward against the work cloth 100. In other words, the position of the feed mechanism 43 is switched to the feed position. In this state, the upper feed device 4 may operate in coordination with the feed dog 34 to feed the work cloth 100.

The contracting force of the spring 468 operates constantly, so the shaft member 467 can be held in the state in which the shaft member 467 has moved to the rear end of the hole 466. The shaft member 464 can therefore be held in the state in which the shaft member 464 has been moved higher than the spring 468. Therefore, the position of the feed mechanism 43 can be held in the state in which the position of the feed mechanism 43 has been switched to the feed position. In the process of the switching of the position of the feed mechanism 43 from the standby position (refer to FIG. 6) to the feed position (refer to FIG. 5), the left end of the shaft member 464 of the extension portion 475 is moved away from the detector switch 457 (refer to FIG. 9), turning the detector switch 457 off. The CPU 61 of the sewing machine 1 can detect that the feed mechanism 43 is in the feed position.

The electrical configuration of the sewing machine 1 will be explained with reference to FIG. 9. As shown in FIG. 9, the control portion 60 of the sewing machine 1 includes the CPU 61, a ROM 62, a RAM 63, the EEPROM 64, and an input/output interface 65, all of which are connected to one another via a bus 67. ROM 62 stores programs for the CPU 61 to perform processing, as well as data and the like. EEPROM 64 includes the sewing data table storage area 641. A plurality of sewing data tables including sewing data table 90 (refer to FIG. 10), which will be described below, are stored in the sewing data table storage area 641. EEPROM 64 also stores various types of other data. RAM 63 may store various types of temporary data.

The switch cluster 21, the touch panel 26, drive circuits 71, 72, 74, 75, and the connector 141 are electrically connected to the input/output interface 65. The drive circuit 71 may drive the feed adjustment motor 78. The drive circuit 72 may drive the sewing machine motor 79. The drive circuit 74 may drive the needle bar swinging motor 80. The drive circuit 75 may drive the liquid crystal display 15.

The connector 141 may be connected to one end of the connecting portion 52. The connecting portion 52 is connected to the connector 504. The connector 504 is electrically connected to the detector switch 457 and drive circuits 151 and 152. The connector 504 and the drive circuits 151 and 152 and are mounted on the electric substrate 498. The drive circuit 151 may drive the motor 491. The drive circuit 152 may drive the solenoid 53. By controlling the drive circuit 151, the CPU 61 can control the driving of the motor 491. By controlling the drive circuit 152, the CPU 61 can drive the solenoid 53. The CPU 61 also can detect the output (the on/off state) of the detector switch 457.

Although this is not shown in the drawings, the circuitry is configured such that a Low signal is input to the CPU 61 in a case where the upper feed device 4 is connected via the connector 141. Furthermore, the circuitry is configured such that a High signal is input to the CPU 61 in a case where the upper feed device 4 is not connected via the connector 141. By detecting one of the Low signal and the High signal, the CPU 61 can detect whether the upper feed device 4 and the sewing machine are electrically connected.

Figure 11:
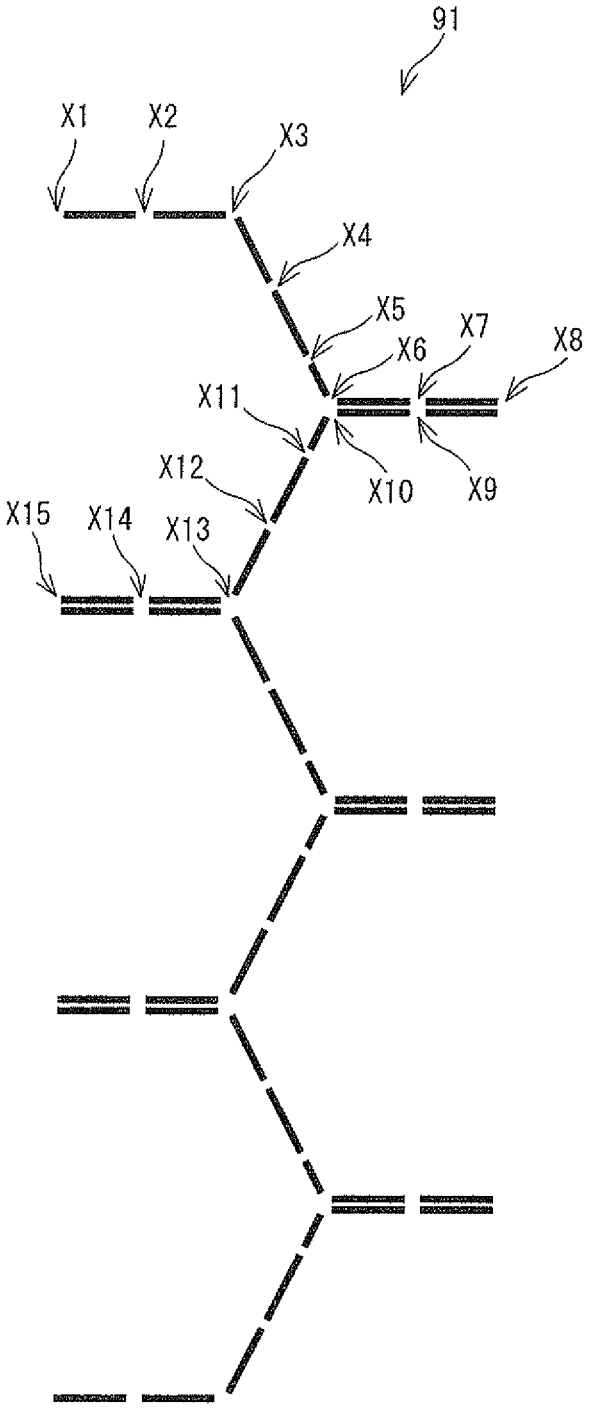
FIG. 11 is a sewing pattern that is to be sewn based on the sewing data table.

The sewing data table 90 will be explained with reference to FIG. 10. The sewing data table 90 is a data table for sewing a sewing pattern 91 that is shown in FIG. 11. In the sewing data table 90, a stitch number N, swing data, front-rear feed data, and transverse feed data are associated with one another. The stitch number N indicates the order in which the sewing is to be performed. Needle drop points X1 to X15 in the swing pattern 91 (refer to FIG. 11) indicate the needle drop points for the stitch numbers N 1 to 15, respectively.

The needle bar of the sewing machine 1, to the lower end of which the sewing needle 29 may be attached, is configured such that the needle bar can be moved (swung) to the left and to the right by the needle bar swinging mechanism. The swing data indicate the amount of movement, in the left-right direction, of the needle drop point of the sewing needle 29 that is attached to the lower end of the needle bar. Among the values for the swing data, a positive value indicates an amount of movement of the needle bar to the right, and a negative value indicates an amount of movement of the needle bar to the left. In the present embodiment, the amount of movement of the needle bar of the sewing machine 1 in the left-right direction is a maximum of 9 millimeters of movement of the needle drop point, and the leftmost position of a needle drop point in the range of movement in the left-right direction is defined as an origin point 0. The needle drop point is the point where the tip (the lower end) of the sewing needle 29 pierces the work cloth 100.

The front-rear feed data indicate the feed amount of the work cloth 100 in the front-rear direction. Among the values for the front-rear feed data, a positive value indicates the feed amount of the work cloth 100 toward the rear, and a negative value indicates the feed amount of the work cloth 100 toward the front. The feed dog 34, operating one of alone and in coordination with the upper feed device 4, may feed the work cloth 100 toward one of the front and the rear by the feed amount that is indicated by the front-rear feed data. The transverse feed data indicate the feed amount of the work cloth 100 in the left-right direction. Among the values for the transverse feed data, a positive value indicates the feed amount of the work cloth 100 toward the left, and a negative value indicates the feed amount of the work cloth 100 toward the right. The feed dog 34 may feed the work cloth 100 toward one of the left and the right by the feed amount that is indicated by the transverse feed data. In the present embodiment, the feed dog 34 can feed the work cloth 100 by 0.5 millimeters to one of the left and the right (transversely) for any one stitch.

Main processing will be explained with reference to the flowchart in FIG. 12. The main processing is performed by the CPU 61 of the sewing machine 1 in accordance with a program that is stored in the ROM 62. The main processing is performed in a case where, for example, a desired pattern has been selected by a panel operation and the sewing start/stop switch has been pressed. In the explanation that follows, the selected pattern is assumed to be the sewing pattern 91 (refer to FIG. 11), and the sewing data for sewing the sewing pattern 91 are assumed to be the data in the sewing data table 90 (refer to FIG. 10).

Figure 12:
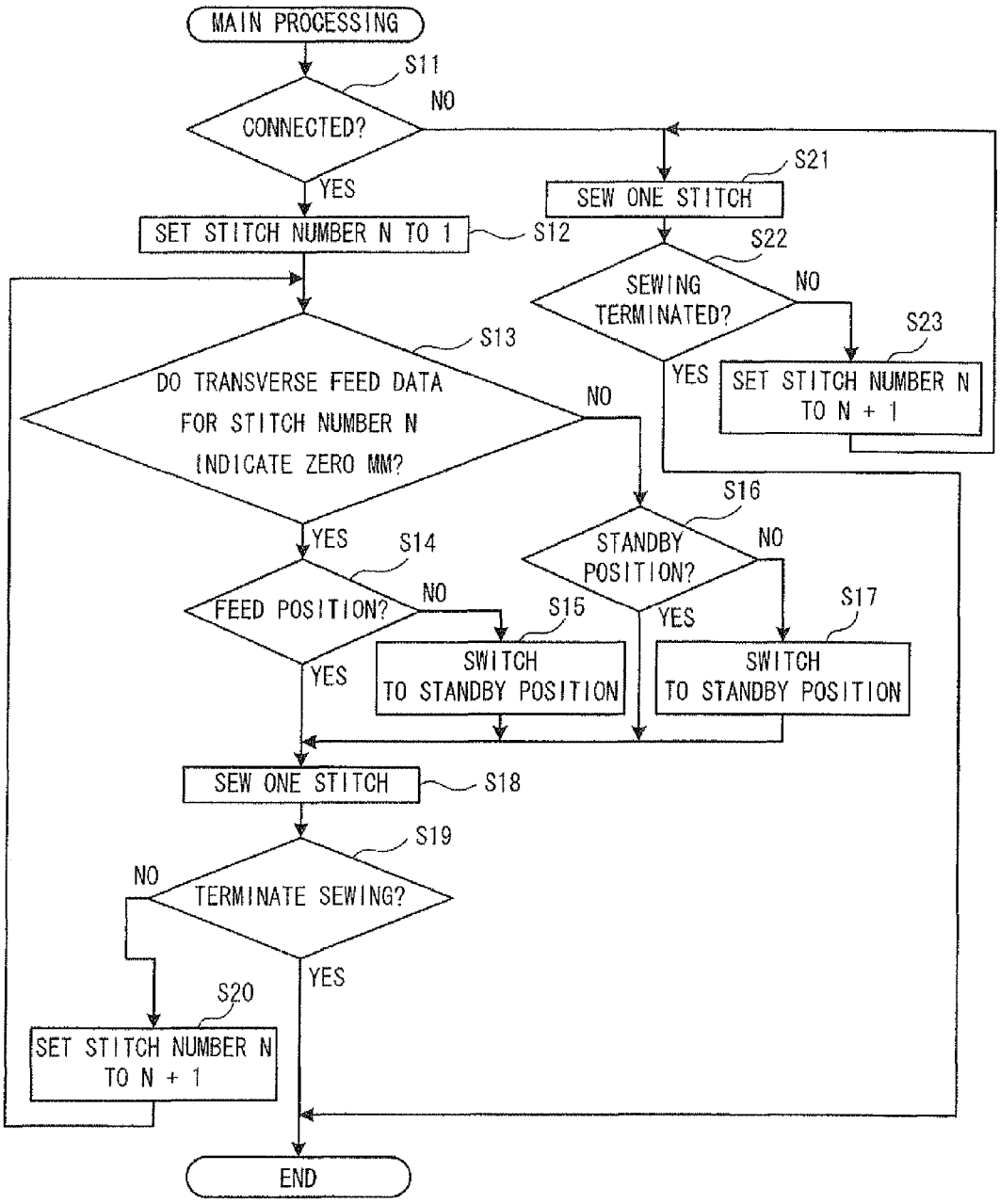
FIG. 12 is a flowchart of main processing.

As shown in FIG. 12, a determination is made as to whether the upper feed device 4 and the sewing machine 1 (the control portion 60) are electrically connected via the connecting portion 52 of the upper feed device 4 (Step S11). The method of detecting whether the upper feed device 4 and the sewing machine 1 are connected at Step S11 is described above. If the upper feed device 4 and the sewing machine 1 are electrically connected (YES at Step S11), the stitch number N is set to 1 (Step S12). The stitch number N is stored in the RAM 63. Next, the sewing data table 90 is referenced, and a determination is made as to whether the value of the transverse feed data that correspond to the stitch number N is zero (millimeters) (Step S13). In other words, a determination is made as to whether the work cloth 100 is to be fed in the front-rear direction, which is the direction in which the feed mechanism 43 can feeds the work cloth 100.

If the value of the transverse feed data that correspond to the stitch number N is zero (millimeters), that is, if the work cloth 100 is to be fed in the front-rear direction (YES at Step S13), the on/off state of the detector switch 457 (refer to FIG. 9) is detected. A determination is thus made as to whether the position of the feed mechanism 43 is in the feed position (refer to FIG. 5) (Step S14). If the detector switch 457 is off, a determination is made that the feed mechanism 43 is in the feed position (YES at Step S14). In this case, the sewing is performed for the stitch that corresponds to the stitch number N in the sewing data table 90 (Step S18). The processing at Step S18 will be described in detail below, using an example.

If the detector switch 457 is on at Step S14, the feed mechanism 43 is in the standby position (refer to FIG. 6). Therefore, a determination is made that the feed mechanism 43 is not in the feed position (NO at Step S14). Next, the solenoid 53 of the switching mechanism 45 is controlled such that the drive shaft 531 is moved obliquely upward and rearward. In this manner, the position of the feed mechanism 43 is switched from the standby position (refer to FIG. 6) to the feed position (refer to FIG. 5) (Step S15). Next, the sewing of the one stitch is performed (Step S18).

After the sewing of the one stitch is performed (Step S18), the CPU 61 determines whether the sewing is to be terminated (Step S19). For example, if the CPU 61 detects that the sewing start/stop switch has been pressed, the CPU 61 determines that the sewing is to be terminated (YES at Step S19). In a case where a text character pattern has been selected for which the stitch numbers N are determined in advance, for example, the CPU 61 determines that the sewing is to be terminated (YES at Step S19) after the sewing of the last stitch in the sewing data table has been performed (Step S18). If the sewing is not to be terminated (NO at Step S19), the CPU 61 increments the stitch number N (Step S20). Next, the processing returns to Step S13.

At Step S13, if the value of the transverse feed data that correspond to the stitch number N is not zero (millimeters) (NO at Step S13), the work cloth 100 is to be fed in the left-right direction, which is the direction in which the feed mechanism 43 cannot feed the work cloth 100. In this case, the on/off state of the detector switch 457 is detected. A determination is thus made as to whether the feed mechanism 43 is in the standby position (refer to FIG. 6) (Step S16). If the detector switch 457 is on, a determination is made that the feed mechanism 43 is in the standby position (YES at Step S16), and the sewing of the one stitch is performed at Step S18, which will be described below.

If the detector switch 457 is off, the feed mechanism 43 is in the feed position (refer to FIG. 5). Therefore, a determination is made that the feed mechanism 43 is not in the standby position (refer to FIG. 6) (NO at Step S16). Next, the solenoid 53 of the switching mechanism 45 is controlled such that the drive shaft 531 is moved obliquely downward and forward. In this manner, the position of the feed mechanism 43 is switched from the feed position (refer to FIG. 5) to the standby position (refer to FIG. 6) (Step S17). Next, the sewing of the one stitch is performed (Step S18).

The processing at Step S18 will be described in detail. At Step S18, first, the work cloth 100 is fed by the feed amounts that are indicated by the front-rear feed data and the transverse feed data in the sewing data table 90. At this time, if the value of the transverse feed data is zero (millimeters) (YES at Step S13), the feed mechanism 43 is disposed in the feed position (refer to FIG. 5) (Step S15 or YES at Step S14). Therefore, the work cloth 100 is fed in the front-rear direction by the coordinated operation of the feed dog 34 and the feed mechanism 43, by the feed amount that is indicated by the front-rear feed data. If the value of the transverse feed data is not zero (millimeters) (NO at Step S13), the feed mechanism 43 is disposed in the standby position (refer to FIG. 6) (Step S17 or YES at Step S16). Therefore, the work cloth 100 is fed in the front-rear direction and the left-right direction by the feed dog 34 alone, by the feed amounts that are indicated by the front-rear feed data and the transverse feed data. Next, the needle bar is moved in the left-right direction by the amount of movement that is indicated by the swing data, the needle bar is driven up and down, and the sewing of the one stitch is performed.

A case will be explained in which the execution of the main processing is started when the feed mechanism 43 of the upper feed device 4 is in the standby position (refer to FIG. 6), and the sewing is performed based on the sewing data table 90 (refer to FIG. 10). In a case where the stitch number N is 1, the values of the swing data, the front-rear feed data, and the transverse feed data are all zero (millimeters) (refer to FIG. 10). Therefore, the determination is made that the value of the transverse feed data is zero (millimeters) (YES at Step S13). Then the position of the feed mechanism 43 is switched to the feed position (refer to FIG. 5) (NO at Step S14; Step S15). At Step S18, the needle bar is moved up and down and the sewing is performed (refer to the needle drop point X1 in FIG. 11) without the work cloth 100 being fed and without the needle bar being moved in the left-right direction. In a case where the values of the swing data, the front-rear feed data, and the transverse feed data are all zero (millimeters), the work cloth 100 is not fed. Therefore, the processing may be set such that the switching of the position of the feed mechanism 43 is not performed.

If the sewing is continued (NO at Step S19), the stitch number N is incremented such that the stitch number N is set to 2 (Step S20). Next, because the value of the transverse feed data for the stitch number N "2" is 0.5 (millimeters) (refer to FIG. 10), the determination is made that the value of the transverse feed data is not zero (millimeters) (NO at Step S13). Here, the feed mechanism 43 is in the feed position. Therefore, the determination is made that the position of the feed mechanism 43 is not the standby position (NO at Step S16), and the position of the feed mechanism 43 is switched from the feed position (refer to FIG. 5) to the standby position (refer to FIG. 6) (Step S17).

Next, the value of the front-rear feed data is zero (millimeters), and the value of the transverse feed data is 0.5 (millimeters). Therefore, the feed dog 34 is controlled such that the work cloth 100 is fed 0.5 millimeters to the left. In other words, the needle drop point is moved 0.5 millimeters to the right. The feed mechanism 43 cannot feed the work cloth 100 in the left-right direction. The feed mechanism 43 is separated from the work cloth 100. Therefore, the feed mechanism 43 does not impede the feeding of the work cloth 100 to the left. Accordingly, the work cloth 100 is properly fed to the left. Next, because the value of the swing data is 1.5 (millimeters) (refer to FIG. 10), the needle bar (the sewing needle 29) is moved 1.5 millimeters to the right. In other words, the needle drop point is moved to the right by a total of 2 millimeters. Then the needle bar is moved up and down, and the sewing of the one stitch is performed (Step S18; refer to the needle drop point X2 in FIG. 11). A stitch is thus formed with a length of 2 millimeters in the left-right direction.

If the sewing is continued (NO at Step S19), the stitch number N is set to 3 (Step S20). In the case where the stitch number N is 3, the determination is made that the value of the transverse feed data is not zero (millimeters) (NO at Step S13). Then the determination is made that the feed mechanism 43 is in the standby position (YES at Step S16). The feed dog 34 is controlled such that the work cloth 100 is moved 0.5 millimeters to the left, the needle bar is moved an additional 1.5 millimeters to the right, and the sewing is performed (Step S18; refer to the needle drop point X3 in FIG. 11).

If the sewing is continued (NO at Step S19), the stitch number N is set to 4 (Step S20). In the sewing data table 90, the value of the transverse feed data that correspond to the stitch number N "4" is zero (millimeters), so the determination is made that the value of the transverse feed data is zero (millimeters) (YES at Step S13). In this case, the feed mechanism 43 is in the standby position. Therefore, the determination is made that the feed mechanism 43 is not in the feed position (NO at Step S14), and the position of the feed mechanism 43 is switched from the standby position (refer to FIG. 6) to the feed position (refer to FIG. 5) (Step S15). Next, the value of the front-rear feed data is 2 (millimeters). Therefore, the feed dog 34 and the feed mechanism 43 are controlled such that the work cloth 100 is moved 2 millimeters toward the rear. In other words, the needle drop point is fed 2 millimeters toward the front. At this time, the feed mechanism 43 presses and feeds the work cloth 100. Therefore, the work cloth 100 can be fed more reliably than in a case where only the feed dog 34 feeds the work cloth 100.

Next, because the value of the swing data is 1.0 (millimeters), the needle bar (the sewing needle 29) is moved additional 1.0 millimeters to the right. Then the needle bar is moved up and down, and the sewing of the one stitch is performed (Step S18; refer to the needle drop point X4 in FIG. 11). A stitch is thus formed that extends 2 millimeters toward the front and 1 millimeter toward the right.

If the sewing is continued (NO at Step S19), the stitch number N is set to 5. In the case where the stitch number N is 5, the determination is made that the value of the transverse feed data is zero (millimeters) (YES at Step S13). Then the determination is made that the feed mechanism 43 is in the feed position (YES at Step S14). The feed dog 34 and the feed mechanism 43 are controlled such that the work cloth 100 is moved 2 millimeters toward the rear. The needle bar is moved an additional 1 millimeter to the right, and the sewing is performed (refer to the needle drop point X5 in FIG. 11). The stitch number N is incremented, and the same sort of sewing is repeated. The sewing pattern 91 shown in FIG. 11 is thus formed. When the sewing start/stop switch is pressed, for example, the CPU 61 determines that the sewing is to be terminated (YES at Step S19) and terminates the main processing.

In the processing at Step S11, if the upper feed device 4 is not mounted on the sewing machine 1 (NO at Step S11), the sewing of one stitch is performed (Step S21), based on the sewing data table 90, in the same manner as at Step S18. At Step S21, the upper feed device 4 has not been mounted, so the feeding of the work cloth 100 is performed by the feed dog 34 alone. Next, the CPU 61 determines whether the sewing is to be terminated (Step S22), in the same manner as at Step S19. If the sewing is not to be terminated (NO at Step S22), the CPU 61 increments the stitch number N (Step S23), in the same manner as at Step S20. The processing returns to Step S21, and the sewing is continued. If the sewing is to be terminated (YES at Step S22), the CPU 61 terminates the main processing.

In the present embodiment, the CPU 61 of the sewing machine 1 drives the feed mechanism 43 in the feed position in a case where the feed dog 34 feeds the work cloth 100 in the front-rear direction, based on the sewing data table 90 that is stored in the EEPROM 64 (YES at Step S13; Step S14; Step S15; Step S18). In a case where the feed dog 34 feeds the work cloth 100 in the left-right direction, the CPU 61 operates the solenoid 53 of the switching mechanism 45 such that the position of the feed mechanism 43 is automatically switched from the feed position to the standby position, then performs the sewing (NO at Step S13; Steps S16 to S18). Therefore, when the feed dog 34 feeds the work cloth 100 in a direction (the left-right direction in the present embodiment) that is different from the front-rear direction in which the feed mechanism 43 can feed the work cloth 100, the feed mechanism 43 does not impede the feeding of the work cloth 100. The work cloth 100 can therefore be fed properly in the left-right direction.

The upper feed device 4 in the present embodiment can automatically switch the position of the feed mechanism 43 between the feed position and the standby position. The work cloth 100 can therefore be fed properly in the front-rear direction and in the left-right direction. Therefore, it is possible to sew a pattern (for example, the sewing pattern 91 shown in FIG. 11) that is to be formed as the work cloth 100 is fed in the front-rear direction and in the left-right direction.

In the present embodiment, the work cloth 100 can be moved in the front-rear direction by being clamped between the upper feed device 4 and the feed dog 34. The work cloth 100 may be a work cloth that is difficult to sew (difficult to feed), such as a vinyl cloth, a synthetic leather, or the like, for example, or the work cloth 100 may be a material on which sewing slippage tends to occur, such as a quilted material in which cotton is sandwiched between two layers of cloth, a velvet with a raised nap surface, or the like. In the present embodiment, the work cloth 100 can be fed reliably in the front-rear direction even in these sorts of cases. The quality of the sewing may thereby be improved. As shown in FIG. 5 and the like, there is a case in which ordinary sewing may be performed on two of the work cloths 100, one on top of the other. Even in this sort of case, the upper and lower work cloths 100 can be fed reliably without any slippage. The quality of the sewing may therefore be improved even more. Additionally, in a case where the work cloth 100 is to be fed in the left-right direction, the feed mechanism 43 automatically moves away from the work cloth 100, as described above. Therefore, the work cloth 100 can be fed properly in the left-right direction. The sewing can therefore be performed more efficiently than in a case where the user switches the position of the feed mechanism 43 by a manual operation.

The present disclosure is not limited to the embodiment that is described above, and various types of modifications can be made. For example, in the embodiment that is described above, the position of the feed mechanism 43 is detected by the detecting of the on/off state of the detector switch 457 at Steps S14 and S16. However, the position of the feed mechanism 43 may be detected by a different method. For example, the CPU 61 may store information that indicates that the CPU 61 has controlled the switching mechanism 45 to perform an operation that switches the position of the feed mechanism 43. Then the CPU 61 may detect the current position of the feed mechanism 43 by referencing the stored information about the previously performed operation.

In the embodiment that is described above, the sewing data table 90 is stored in the EEPROM 64, but the present disclosure is not limited to this example. For example, the sewing data table 90 may be stored in an external storage device, such as a memory card that can be mounted in the sewing machine 1.

In the embodiment that is described above, the upper feed device 4 can be mounted on and removed from the sewing machine 1. The upper feed device 4 may be affixed to the sewing machine 1 such that the upper feed device 4 cannot be removed. The upper feed device 4, as well as the various types of mechanisms that are included in the upper feed device 4, may be included in the sewing machine 1.

In the embodiment that is described above, the switching of the position of the feed mechanism 43 (to the feed position and the standby position) is performed by the controlling of the solenoid 53. However, the position of the feed mechanism 43 may be switched by a different method. For example, a motor may be added to the upper feed device 4. The position of the feed mechanism 43 may then be switched by using the driving force of the added motor to operate the lever portion 460. The upper feed device 4 may be configured such that the lever portion 460 can be operated by the solenoid 53 or the like and also the lever portion 460 can be operated manually. The position of the feed mechanism 43 may thus be switched manually.

In the embodiment that is described above, the direction in which the feed mechanism 43 of the upper feed device 4 can feed the work cloth 100 is the front-rear direction, but the present disclosure is not limited to this example. For example, the feed mechanism 43 may be configured to feed the work cloth 100 in the left-right direction. In that case, when the work cloth 100 is to be fed in the left-right direction, the feed mechanism 43 may be disposed in the feed position, and the work cloth 100 may be fed by the coordinated operation of the feed mechanism 43 and the feed dog 34. Then, in a case where the feed dog 34 is to feed the work cloth 100 in the front-rear direction, the position of the feed mechanism 43 may be switched to the standby position. In that case, the work cloth 100 may be fed in the front-rear direction by the feed dog 34 alone.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a first drive portion that is disposed above a bed of the sewing machine and that is configured to drive to feed, in a first direction, a work cloth placed on the bed;

a switching portion that is configured to switch a position of the first drive portion between a first position and a second position, wherein the first drive portion is configured to feed the work cloth at the first position, the first drive portion is configured to be separated from the work cloth at the second position, and the second position is a position that is higher and farther away from the bed than the first position;

a second drive portion that is provided inside the bed and that is configured to drive to feed the work cloth in the first direction and in a second direction that is different from the first direction;

a control portion; and a memory that is configured to store computer-readable instructions that instruct the sewing machine to execute steps of:

driving the first drive portion in the first position, in a case where the second drive portion drives to feed the work cloth in the first direction, based on sewing data, switching the position of the first drive portion from the first position to the second position by operating the switching portion, in a case where the second drive portion drives to feed the work cloth in the second direction, based on the sewing data, and switching the position of the first drive portion from the second position to the first position by operating the switching portion, if the first drive portion is in the second position, in a case where the second drive portion drives to feed the work cloth in the first direction, based on the sewing data.

2. The sewing machine according to claim 1, wherein the switching portion includes an actuator that is configured to switch the position of the first drive portion, and the switching of the position of the first drive portion from the first position to the second position is performed by controlling the actuator.

3. The sewing machine according to claim 1, wherein the switching portion includes an actuator that is configured to switch the position of the first drive portion, and the switching of the position of the first drive portion from the second position to the first position is performed by controlling the actuator.

4. The sewing machine according to claim 1, wherein the first drive portion includes:

a motor;

a first pulley that is configured to be rotated in conjunction with a rotation of the motor;

a second pulley that is separated from the first pulley, that is disposed above the bed, and that is configured to be rotated in conjunction with a rotation of the first pulley; and a belt that is provided around the first pulley and the second pulley and that is configured to be moved in conjunction with the rotation of the first pulley rotated by the motor, and a contact portion is configured to be in contact with the work cloth when the first drive portion is in the first position and to be separated from the work cloth when the first drive portion is in the second position, the contact portion being a part of the belt that is below the second pulley.

5. An upper feed device comprising:

a first drive portion that is disposed above a bed of a sewing machine and that is configured to drive to feed, in a first direction, a work cloth placed on the bed;

a switching portion that is configured to switch a position of the first drive portion between a first position and a second position, wherein the first drive portion is configured to feed the work cloth at the first position, and configured to be separated from the work cloth at the second position, the second position is a position that is different from the first position, and in response to instructions that are output by a control portion of the sewing machine based on sewing data:

the first drive portion drives in the first position in a case where a second drive portion drives to feed the work cloth in the first direction, the switching portion switches the position of the first drive portion from the first position to the second position in a case where the second drive portion drives to feed the work cloth in a second direction that is different from the first direction, the second drive portion being provided inside the bed, and the switching portion switches the position of the first drive portion from the second position to the first position, if the first drive portion is in the second position, in a case where the second drive portion drives to feed the work cloth in the first direction, in response to instructions that is output by the control portion based on the sewing data.

6. The upper feed device according to claim 5, wherein the switching portion includes an actuator that is configured to switch the position of the first drive portion, and the actuator switches the position of the first drive portion from the first position to the second position in response to instructions that is output by the control portion.

7. The upper feed device according to claim 5, wherein the switching portion includes an actuator that is configured to switch the position of the first drive portion, and the actuator switches the position of the first drive portion from the second position to the first position in response to instructions that is output by the control portion.

8. The upper feed device according to claim 5, wherein the first drive portion includes:

a motor;

a first pulley that is configured to be rotated in conjunction with a rotation of the motor;

a second pulley that is separated from the first pulley, that is disposed above the bed, and that is configured to be rotated in conjunction with a rotation of the first pulley; and a belt that is provided around the first pulley and the second pulley and that is configured to be moved in conjunction with the rotation of the first pulley rotated by the motor, and a contact portion is configured to be in contact with the work cloth when the first drive portion is in the first position and to be separated from the work cloth when the first drive portion is in the second position, the contact portion being a part of the belt that is below the second pulley.

* * * * *